United States Patent [19]

Misono

[11] Patent Number: 4,781,639

[45] Date of Patent: Nov. 1, 1988

[54] CULLETLESS MAIN SEALING METHOD OF CATHODE-RAY TUBE

[75] Inventor: Masayoshi Misono, Chiba, Japan

[73] Assignee: Hitachi, Ltd., Tokyo, Japan

[21] Appl. No.: 898,536

[22] Filed: Aug. 21, 1986

[30] Foreign Application Priority Data

Sep. 20, 1985 [JP] Japan ..... 60-206412

[51] Int. Cl.[4] ..... H01J 9/26

[52] U.S. Cl. ..... 445/43; 445/45; 445/22

[58] Field of Search ..... 445/3, 22, 43, 45, 44; 65/54, 59.2

[56] References Cited

U.S. PATENT DOCUMENTS 2,273,439 2/1942 Freeman ..... 445/22
2,321,224 6/1943 Madden ..... 445/22
3,369,881 2/1968 Bennett ..... 445/45
3,460,879 8/1969 Fletcher ..... 445/43

FOREIGN PATENT DOCUMENTS 0144659 12/1978 Japan ..... 445/45
0108145 8/1980 Japan ..... 445/45

*Primary Examiner*—Kurt Rowan
*Attorney, Agent, or Firm*—Antonelli, Terry & Wands

[57] ABSTRACT

A culletless main sealing method comprising the steps of heating the end surface of a neck tube of a bulb by burners, pushing a stem to the end surface of the neck tube for welding the stem thereto, and pulling the stem to shape the welded portion. The burners are located at a predetermined constant distance from the plane containing the end surface of the neck tube, and the pushing distance and the pulling distance of the stem at the time of glass welding are determined in accordance with the length of the neck tube, whereby the allowable variation range of the length of the neck tube is enlarged.

2 Claims, 3 Drawing Sheets

CULLETLESS MAIN SEALING METHOD OF CATHODE-RAY TUBE

BACKGROUND OF THE INVENTION

The present invention relates to a culletless main sealing method of a cathode-ray tube, especially of a color picture tube of the type which does not produce a cullet during a sealing process.

FIG. 1 is an external view of a color picture tube after it is sealed enclosing an electron gun. The reference numeral 1 denotes a panel, 2 a funnel, and 3 a neck tube. The line A indicates an assumed datum line which is called a reference line, B a position of the under surface of a stem, and the distance $l_1$ between A and B is determined from a point of view of a design.

FIG. 2 is an external view of a color picture tube before the sealing process of the type which produces a cullet after it is sealed enclosing an electron gun. The reference numeral 4 denotes a neck flare portion, and the neck tube 3 is cut by fusing at the portion C during the sealing process. The portion of the neck tube 3 including the neck flare portion 4 after it has been cut is a cullet.

FIG. 3 is an external view of a color picture tube before the sealing process of the type which does not produce a cullet and which is disclosed, for example, in Japanese Patent Laid-Open No. 128542/1981. This type of the tube is called a culletless tube, because the neck tube is cut at the position D in advance and thereby does not produce a cullet. The main sealing method of this type of color picture tube will be explained hereinunder.

This type of cathode ray tube is sealed enclosing an electron gun in the following way. The end surface of the neck tube is first softened by heating it with a gas burner. The stem preheated to a predetermined temperature is next pushed to the softened neck tube to be welded to the end portion of the neck tube. Thereafter, the stem is pulled and the welded portion is shaped so that the inner and outer surfaces of the welded portion are made even and have a uniform thickness. The stem here means a glass for fixing a lead, namely, the portion indicated by the reference numeral 8 in FIG. 8*a* which will be described later, and after it is welded to the neck tube, the portion is shown, for example, by the numeral 8 in FIG. 6*a*.

If the distance $l_2$ between A and D in FIG. 3 varies, the positions of the end surface 5, with which the flames 6 of the gas burner for heating the end surface 5 of the neck tube 3 come into contact, also vary as shown in FIGS. 4*a*–4*c*. In an ordinary sealing equipment, the bulb is set with the panel 1 faced upward on the basis of the reference line A. FIG. 4*a* shows a normal case. In FIG. 4*b* the distance $l_2$ is so short that the flames 6 come out of contact with the end surface 5, resulting in inadequate heating of the end surface 5. In FIG. 4*c*, the distance $l_2$ is so long that the flames 6 heat the outer peripheral surface of the neck tube 3, thereby causing a difference in temperatures between the inner and outer surfaces of the neck tube 3, which disadvantageously makes the neck tube 3 easy to break and largely deforms it.

FIG. 5 shows an example of arrangement of burners 7, which are disposed apart from the plane containing the end surface 5 by the distance $l_3$ such that the flames 6 come into contact with the end surface 5 of the neck tube 3 in an oblique direction. This method can cope with the variation of the distance $l_2$, but the acceptable variation range is narrow. As a result, the bulb of a color picture tube is required to have a high precision, leading to an increase in cost.

Furthermore, with the variation of the distance $l_2$, the volume of the welded portion between the heated end surface of the neck tube and the stem varies and, hence, the shape of the welded portion also varies when the stem is pulled in order to shape the welded portion after welding. FIGS. 6*a* and 6*b* are schematic sectional views of the stem and its vicinity after the completion of sealing. In FIG. 6*a*, the distance $l_2$ is so short that some portion of the neck tube 3 in the vicinity of the stem 8 is extremely small in thickness (t), and if $l_2$ is further shorter, a hole will be made between the neck tube 3 and the stem 8. On the other hand, in FIG. 6*b*, the distance $l_2$ is so long that the welded portion is protruded outwardly from the neck tube 3, thereby making it impossible to attach a base thereto after the completion of evacuation. To prevent these troubles, the dimension $l_2$ is required to have a high precision.

SUMMARY OF THE INVENTION

Accordingly, it is an object of the present invention to provide a culletless main sealing method of a cathode-ray tube, in particular, a color picture tube, which is capable of enlarging the allowable variation range of the dimension of the length from the reference line to the end surface of the neck tube, and is thereby capable of reducing cost.

To achieve this aim, a culletless main sealing method of a cathode-ray tube according to the present invention includes the steps of heating the end surface of a neck tube of a bulb by burners, welding a stem to the end surface of the neck tube with the stem pushed thereto, and pulling the stem to shape the welded portion, and is characterized in that the positions of the burners with respect to the end surface of the neck tube, and the pushing distance of the stem during glass welding with respect to the neck tube and the pulling distance of the stem after the glass welding with respect to the neck tube are controlled in accordance with the length of the neck tube.

The positions of the burners are so controlled that the distance between the plane containing the end surface of the neck tube and the burners takes a predetermined constant value. If the distance is too long, heating of the end surface of the neck tube is inadequate, while if it is too short the outer surface of the neck tube is heated, both cases being inconvenient.

The pushing distance of the stem is so controlled that the distance by which the stem is pushed after it is brought into contact with the end surface of the neck tube takes a predetermined constant value. If the pushing distance is too long, the welded portion is deformed, while too short a pushing distance makes the hole between the neck tube and the stem due to incomplete welding, both cases being inconvenient.

The pulling distance of the stem is so controlled as to be shorter by a predetermined constant value than the pushing distance, namely, the distance between the position at which the stem is initially set and the position at which the stem lies at the completion of the pushing process. If the pulling distance is too long, the welded portion is too thin, while if it is too long the welded portion is too thick, both cases being inconvenient.

The predetermined constant values in the above-described steps can be determined by simple experiments.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
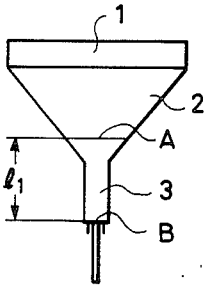
FIG. 1 is a schematic external view of a color picture tube after it is sealed enclosing an electron gun.
Figure 2:
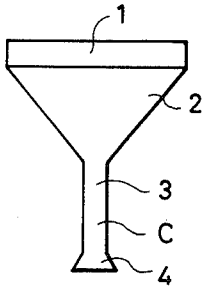
FIG. 2 PRIOR ART
FIG. 2 is a schematic external view of a color picture tube before the sealing process of the type which produces a cullet after it is sealed enclosing an electron gun.
Figure 3:
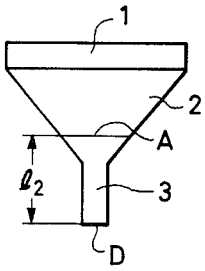
FIG. 3 is a schematic external view of a color picture tube before the sealing process of the type which does not produce a cullet after it is sealed enclosing an electron gun.
Figure 4A:
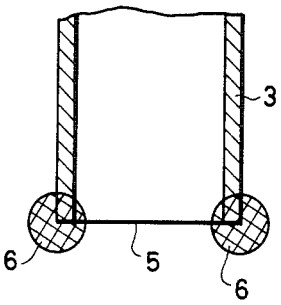
FIG. 4*a* is an explanatory schematic view of the positional relationship between the flames of gas burners and a neck tube in the case in which the length of the neck tube is normal.
Figure 4B:
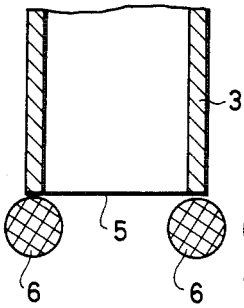
FIG. 4*b* is an explanatory schematic view of the positional relationship between the flames of gas burners and a neck tube in the case in which the length of the neck tube is too short.
Figure 4C:
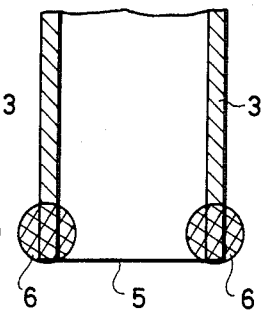
FIG. 4*c* is an explanatory schematic view of the positional relationship between the flames of gas burners and a neck tube in the case in which the length of the neck tube is too long.
Figure 5:
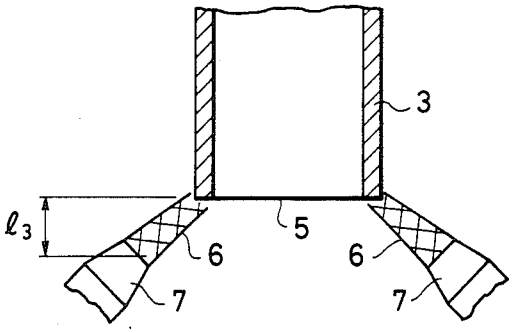
FIG. 5 is a schematic view of an example of the arrangement of gas burners with respect to the neck tube.
Figure 6A:
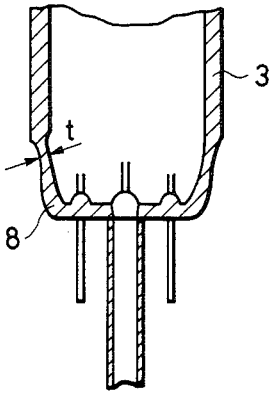
FIG. 6*a* is a schematic sectional view of a stem and its vicinity in the case in which the neck tube is too short.
Figure 6B:
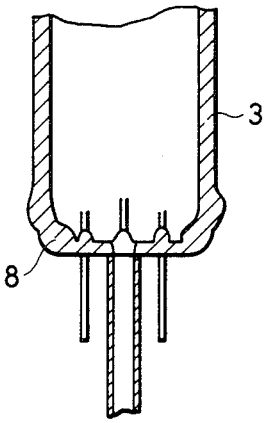
FIG. 6*b* is a schematic sectional view of a stem and its vicinity in the case in which the neck tube is too long.
Figure 7A:
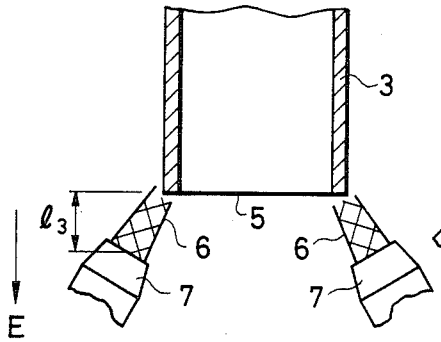
FIGS. 7*a* and 7*b* are schematic views of the controlled positions of the gas burners in an embodiment of the present invention.
Figure 7B:
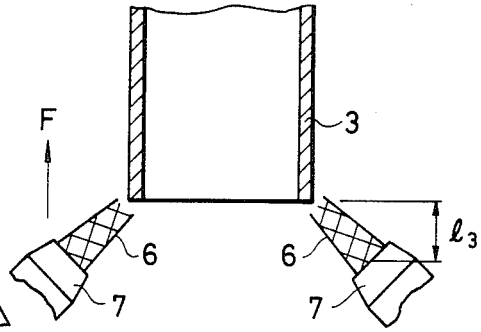

An embodiment of the present invention will be described hereinunder with reference to FIGS. 7*a*, 7*b*, 8*a*, 8*b* and 8*c*. The distance $l_2$ shown in FIG. 3 is measured in advance. As shown in FIGS. 7*a* and 7*b*, the positions of the burners 7 during heating the neck tube 3 are controlled in accordance with the dimension of $l_2$ so that the distance $l_3$ between the plane containing the end surface 5 of the neck tube 3 and the burner 7 takes a predetermined constant value. If $l_2$, namely, the length of the neck tube 3 is too long, as shown in FIG. 7*a*, the burners 7 are moved in the direction indicated by the arrow E when heating the neck tube 3. On the other hand, if the length of the neck tube 3 is too short, as shown in FIG. 7*b*, the burners 7 are moved in the direction indicated by the arrow F for heating the neck tube 3. In both cases, the burners 7 are moved such that the distance $l_3$ during heating constantly takes a predetermined value.

Figure 8A:
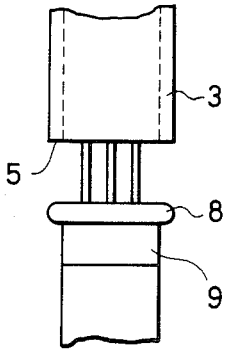
FIGS. 8*a* to 8*c* are schematic views of the sealing process in the embodiment of the present invention.
Figure 8B:
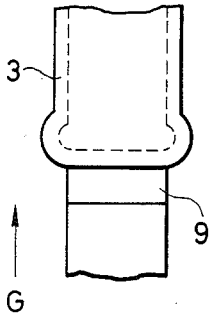
Figure 8C:
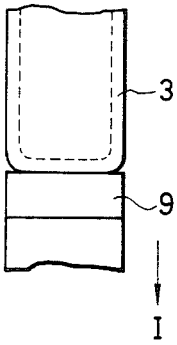

The stem 8 is next sealed by the steps shown in FIGS. 8*a* to 8*c*. FIG. 8*a* shows the stem 8 in a state immediately before welding. The stem 8 is set on a mount pin base 9 which is a kind of jig. Since the mount pin base 9 is preheated, the temperature of the stem 8 has also risen. The stem 8 must be preheated because the stem 8, which is made of glass, is broken if it is rapidly heated at the time of welding. For this purpose, the mount pin base 9 is preheated so that its heat conduction raises the temperature of the stem 8. The preheating temperature of the stem 8 is at most 400° C. Since the end surface 5 of the neck tube 3 has been adequately heated and softened by the gas burners 7, as described above, the stem 8 is welded to the neck tube 3 by pushing the mount pin base 9 in the direction indicated by the arrow G, as shown in FIG. 8*b*. At this time the pushing distance of the stem 8 is controlled in accordance with the measured distance $l_2$ of the neck tube 3 so that the distance $l_4$ by which the stem 8 is pushed after it is brought into contact with the end surface 5 takes a predetermined constant value. If the distance between the position at which the stem 8 is initially set and the position at which the stem lies at the completion of the pushing process, namely, the pushing distance is X, and the distance between the position at which the stem 8 is initially set and the reference line A is S, X is so controlled as to take the value which satisfies the following formula: $X=S-l_2+l_4$. The distances S and $l_4$ are respectively constant values determined in each sealing process.

Thereafter the mount pin base 9 is pulled in the direction indicated by the arrow I, as shown in FIG. 8*c*, to shape the welded portion. At this time, the pulling distance is controlled in accordance with the value of $l_2$. The pulling distance Y takes the value obtained by subtracting a predetermined constant value $l_5$ from the pushing distance X and is expressed the following formula: $Y=X-l_5$.

Since the positions of the burners 7, and the pushing and pulling distances of the stem 8 are controlled in this way in accordance with the length of the neck tube, the allowable variation range of $l_2$ is enlarged, which leads to reduction in manufacturing cost of the bulb. In addition, since the condition for the sealing process is constant, the yield in the process is enhanced.

Experiments were carried on this embodiment in the manufacture of a 14-inch type color picture tube under the condition that the distance $l_3$ between the plane containing the end surface of the neck tube and the burners was 10 mm, the distance $l_4$ by which the stem is pushed after the stem is brought into contact with the end surface of the neck tube was 3 mm, and the difference $l_5$ between the pushing distance X and the pulling distance Y of the stem was 2 mm. Good results were obtained even when the lengths of the neck tubes varied by about ±2 mm. The pushing distance X varies in correspondence with the value of $l_2$, but in these experiments it was so controlled as to have a mean value of about 7 mm. The length $l_2$ was about 100 mm on the average. The angle between the flame 6 and the end surface 5 of the neck tube was 5° to 20° C.

In this embodiment, the burners were moved and the stem was pushed and pulled by means of a pulse motor, whereby each of the distances of movement was controlled. However, it is not necessary to specify the method for the movement and control of the distances of movement of these elements.

Additionally, in each of the drawings the same reference numerals denote the same portions.

As is clear from the above explanation, according to the present invention, the allowable variation of the length of the neck tube is enlarged, which leads to reduction in cost and enhancement of yield.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. In a culletless main sealing method of a cathode-ray tube including the steps of heating the end surface of a neck tube of a bulb by burners, pushing a stem to said end surface of said neck tube for glass welding said stem thereto, and pulling said stem to shape the welded portion, the improvement comprising the steps of:

(i) determining the positions of said burners in accordance with the length of said neck tube so as to locate said burners at a predetermined constant distance from a plane containing said end surface of said neck tube;

(ii) determining the pushing distance of said stem, during glass welding, from the position at which said stem is initially set with respect to said neck tube in accordance with the length of said neck tube so that the distance by which said stem is pushed after said stem is brought into contact with said end surface of said neck tube is a predetermined constant value; and (iii) determining the pulling distance of said stem, after said glass welding, with respect to said neck tube in accordance with the length of said neck tube so as to be shorter by a predetermined constant value than said pushing distance from the position at which said stem is initially set.

2. A culletless main sealing method of a cathode-ray tube comprising the steps of:

(i) measuring a distance $l_2$ between a reference line of a culletless cathode-ray tube and an end surface of a neck tube of said cathode-ray tube;

(ii) disposing burners at a predetermined constant distance from a plane containing said end surface of said neck tube by adjusting the positions of said burners in accordance with the measured distance $l_2$;

(iii) heating said end surface of said neck tube by said burners;

(iv) pushing a stem to said end surface of said neck tube for glass welding said stem thereto by moving said stem to the side of said neck tube for a distance X represented by a formula $X=S-l_2+l_4$ where a distance from the position, at which said stem is initially set to said reference line is a predetermined constant value S, and a pushing distance by which said stem is pushed after said stem is brought into contact with said end surface of said neck tube is a predetermined constant value $l_4$; and (v) pulling said stem, pushing to said end surface of said neck tube, to shape the welded portion for a distance Y represented by a formula $Y=X-l_5$, where $l_5$ is a predetermined constant value.

* * * * *